United States Patent [19]

Szamek

[11] 4,412,685

[45] Nov. 1, 1983

[54] RECREATIONAL SKATE

[76] Inventor: Pierre E. Szamek, 30 Van Velsor Pl., Newark, N.J. 07112

[21] Appl. No.: 106,652

[22] Filed: Dec. 26, 1979

[51] Int. Cl.[3] ..... A63C 17/00

[52] U.S. Cl. ..... 280/11.19; 280/11.27

[58] Field of Search ..... 280/11.1 BR, 11.1 R, 280/11.1 BF, 11.19, 11.27, 11.28, 11.23, 7.13

[56] References Cited

U.S. PATENT DOCUMENTS 979,169 12/1910 Kennedy ..... 280/11.23

2,165,581 7/1939 Schroeder ..... 280/11.1 R

FOREIGN PATENT DOCUMENTS 282418 8/1952 Switzerland ..... 280/11.23

*Primary Examiner*—David M. Mitchell

*Assistant Examiner*—Timothy Roesch

*Attorney, Agent, or Firm*—Carella, Byrne, Bain & Gilfillan

[57] ABSTRACT

There is disclosed a novel skate structure comprised of a support platform and roller devices wherein the support platform is pivotally mounted to the roller devices by first and second ring bearings having inner and outer races wherein the outer race of the first ring bearing is rigidly secured to the support platform and wherein the outer race of the second ring bearing is rigidly secured to the inner race of the first ring bearing and wherein the roller devices are secured to the inner race of the second ring bearing.

1 Claim, 9 Drawing Figures

RECREATIONAL SKATE

BACKGROUND OF THE INVENTION

1. Field of the Invention

This invention relates to roller skates. More particularly, this invention relates to a new and improved skate structure which is suitable for use on rink surfaces, floors, sidewalks, streets and other surfaces which are sufficiently smooth to permit safe skating.

2. Description of the Prior Art

Roller skating is an age old recreation. Children of all ages long have attached skates to their shoes with strap and key clamps so as to enjoy the thrill of speed, mobility and participation in games of schoolyard hockey, group skating and similar activities.

Ballroom roller skating, usually in indoor roller skating rinks, permitted skaters to enjoy perfectly smooth surfaces constructed for that purpose. In these rinks, singles, pairs and groups of skaters, usually wearing shoe-skates, skated, danced, spun and performed other moves for the entertainment of themselves and of spectators.

More recently, roller skating has taken on new dimensions. Serious skaters are using skates to reduce energy consumption. Recreational skaters are engaging in activities ranging from athletic competitions to disco-dance skating.

Beyond the advance from clamp-on skates to shoe skates there have been very few significant developments in skating equipment. Wheels have been improved as a result of improvements in synthetic material technology and bearing structures have been improved through the use of developing bearing technology. However, the basic roller skate which is in use today still constitutes a four wheel support with the wheels having limited degrees of movement such as to permit turning and the like without lifting the skate from the skating surface.

It has been recognized by those concerned with this field that increased ranges of movement would be desirable. Such is particularly true with respect to skating activities such as disco-skating and free-style skating.

Most attempts to provided increased ranges of mobility in roller skates have resulted in resort to use of ball bearings as the support means for the skates. Typical of such structures are those shown in U.S. Pat. No. 1,271,891 for Roller Skate, U.S. Pat. No. 4,076,263 for Ball Skate and British Pat. No. 533,957 of Improvements in or Relating to Roller Skates. The use of balls as primary support elements is disadvantageous, however, because it places highly concentrated loads on both the ball structure and on the supporting surface. Still further, a pure ball bearing support is inefficient for skating purposes because it provides no possibility for generation of the transverse reactive forces which are necessary to permit the skater to propel himself, indeed to be able to stand up.

SUMMARY OF THE INVENTION

It is an object of the present invention, therefore, to provide a skate construction which utilizes a support structure having 360° range of movement but which also provides sufficient reactive capability to permit a skater to achieve movement and to maintain control.

Another object of the present invention is to provide a skate construction which is self-supporting, i.e. has more than two point or single line contact with a support surface.

Yet an additional object of the present invention is to provide a skate structure which has multiple line contact with a supporting surface so as to distribute the load and minimize weight loading on the skate structure and concentrated loading on the support surface.

These and other objects not enumerated are achieved by the skate structure of the present invention. One embodiment of which may include a support platform, roller means for providing a rolling contact between the skate structure and a support surface and means for pivotally mounting the roller means on the support platform.

BRIEF DESCRIPTION OF THE DRAWINGS

A more complete understanding of the present invention may be had from the following detailed description, particularly when read in the light of the accompanying drawings wherein.

DETAILED DESCRIPTION

As noted above, this invention relates to the general art of roller skates. More particularly, this invention relates to a new and improved skate structure which is suitable for use on rink surfaces, floors, sidewalks, streets and other surfaces which are sufficiently smooth to permit safe skating.

Figure 1:
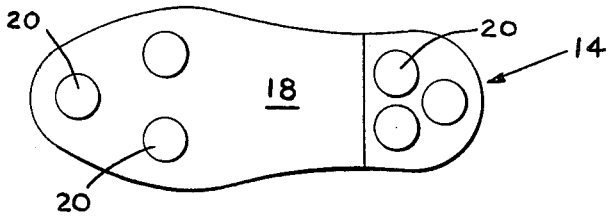
FIG. 1 is a bottom view of a skate structure incorporating the teaching of the present invention.
Figure 2:
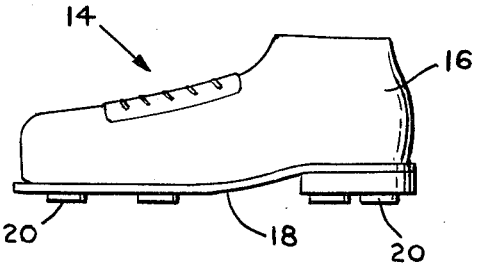
FIG. 2 is a side elevational view of the structure of FIG. 1.
Figure 3:
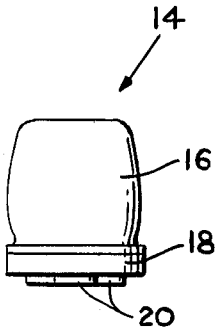
FIG. 3 is an end elevational view of the skate structure of FIG. 1.

Accordingly, with reference to FIGS. 1 through 3, a shoe skate incorporating skate structure in accordance with the present invention is shown and designated generally by the reference numeral 14. Skate 14 comprises a shoe upper 16, a support platform 18 which, in the present case comprises the shoe, sole and heel, and a plurality of bearing means 20 for supporting and permitting mobility of a skater all as is discussed below in detail.

For purposes of the present disclosure the skate structure of the invention is shown in conjunction with a shoe skate. It should be recognized, however, that support platform 18, rather than comprising the sole and heel sections of a shoe skate, may well comprise an independent platform adapted for attachment to a conventional shoe such as by clamping devices, straps or the like, all as is well known in these arts.

Bearing means 20 for use in conjunction with skate 14 may be suitably selected from among the structures disclosed in FIGS. 4 and 5, 6 and 7 and 9. Further, it is within the contemplation of this invention that the plurality of bearing means 20 as used with respect to skate 14 may be any combination of the respective bearing structures in order to achieve a particular desired effect within the discretion of the skater.

Figure 4:
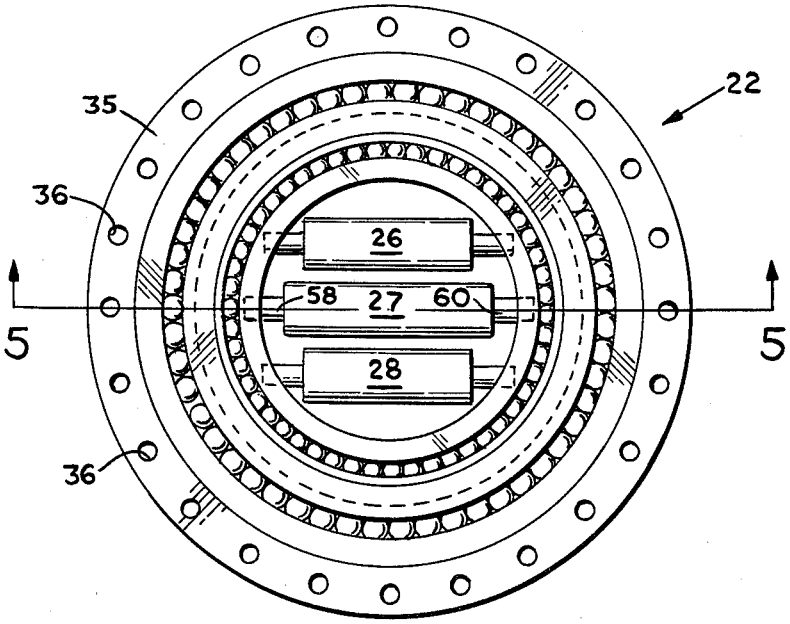
FIG. 4 is a plan view of bearing elements which may be utilized in conjunction with the present invention.
Figure 5:
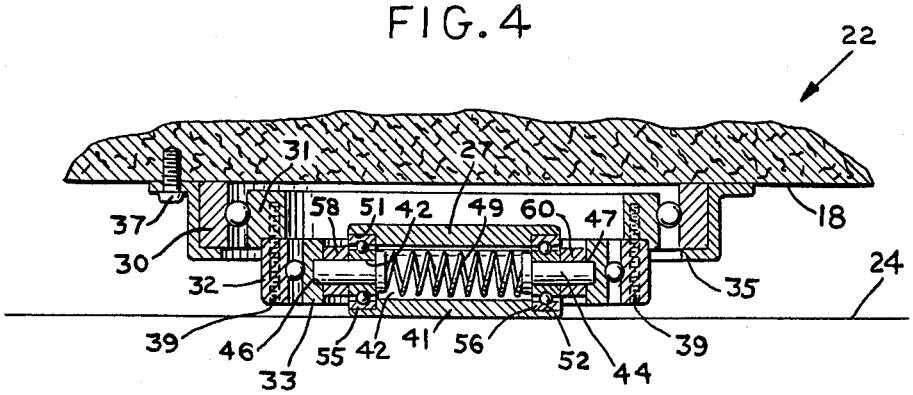
FIG. 5 is a cross-sectional elevational view through the plane 5—5 of FIG. 4.

Considering, therefore, the particular structure of the bearing, there is shown in FIGS. 4 and 5 a bearing structure designated generally by the reference numeral 22. Bearing structure 22 comprises broadly a roller means for providing a rolling contact between the skate structure and a support surface such as floor 24 and a means for pivotally mounting the roller means on a support platform 18 which in this case is either the sole or heel of skate 14.

Broadly stated, the roller means comprises three roller elements 26, 27 and 28 which are mounted within the inner race of a ring bearing comprising part of the pivotal mounting structure as is discussed below in detail.

The pivotal mounting structure comprises a first ring bearing having an outer race ring 30, an inner race ring 31 and a plurality of balls to provide low friction movement therebetween in the known sense.

The second ring bearing comprises an outer race ring 32, an inner race ring 33 and a plurality of balls therebetween to provide for relatively frictionless rotation of the inner ring with respect to the other ring.

Outer race ring 30 of the first ring bearing is rigidly secured to structural platform 18 by a clamp ring 35 having a plurality of holes 36 through which pass securing screws 37 for cooperation with suitable openings formed in support platform 18. Thus, it can be seen that as outer race ring 30 is secured with respect to support platform 18, inner race ring 31 is permitted to rotate within outer race ring 30. Outer race ring 32 of the second ring bearing is rigidly secured to inner race ring 31 of the first ring bearing by suitable machine screws 39 which pass through bores formed in outer race ring 32 and are threadedly received within tapped bores formed within inner race ring 31. Thus, with such structure, it can be seen that inner race ring 31 of the first ring bearing together with outer race ring 32 of the second ring bearing may rotate freely within outer race ring 30 of the first ring bearing and further, inner race ring 33 of the second ring bearing may rotate freely and independently of outer race ring 32, inner race ring 31 and outer race ring 30 of the respective bearings.

Inner race ring 33 of the second ring bearing is provided with a plurality of opposed pairs of bores, the longitudinal axes of which are parallel and which define bores for receiving therein roller elements 26, 27 and 28. Referring specifically to FIG. 5, there is shown in detail a cross-sectional elevational view of roller element 27 which is typical of the roller element structures of roller elements 26 and 28. Accordingly, only the detailed structure of roller element 27 will be described, it being recognized that the structures of roller elements 26 and 28 are identical thereto. It should be further noted that although three roller elements are shown in conjunction with bearing structure 22, there may be roller elements from one to any desired number limited only by the particular physical dimension of structure to be provided.

Considering, therefore, the specific structure of roller element 27 and with particular reference to FIG. 5, it can be seen that roller element 27 incorporates a generally cylindrical roller 41 through which is provided a throughbore 42. Disposed within throughbore 42 are a first support rod 43 and a second support rod 44. The outer ends of support rods 43 and 44 are slidably received within bores 46 and 47 respectively formed in inner race ring 33 of the second ring bearing as discussed above.

As is evident from FIG. 5, roller 41, throughbore 42, first support rod 43, second support rod 44, bore 46 and bore 47 are coaxial, their axes defining the axis of rotation of roller 41 as the skate structure passes along support structure 24.

Disposed within throughbore 42 and received between first and second support rods 43 and 44 is a spring member 49 which acts to urge support rods 43 and 44 outwardly of throughbore 42 and into bores 46 and 47 respectively.

Formed in opposed ends of roller 41 are counterbores 51 and 52. Counterbores 51 and 52 accommodate the mounting therein of bearing elements 55 and 56. More specifically, bearing element 55 comprises a bearing having an inner race and an outer race and a plurality of ball members therebetween. The outer race is rigidly secured to roller 41 by surface-to-surface engagement with the inner surface of counterbore 51. The inner race of bearing 55 is rigidly secured to first support rod 43 e.g. by surface-to-surface engagement with the external surface of support rod 43.

Similarly, bearing element 56 comprises a bearing having an outer race and an inner race, the outer race being rigidly secured to roller 41 by surface-to-surface engagement with the inner surface of counterbore 52 and the inner race of which is rigidly secured to second support rod 44 by being in surface-to-surface engagement with the external surface of support rod 44. Disposed between the outer edge of inner race of bearing 55 and the inner surface of inner race ring 33 of the second ring bearing is a suitable spacer element 58 which precludes the end of roller 41 from coming in contact with the surface of inner race ring 33.

Similarly, disposed between the outer end of the inner race of bearing element 56 and the inner surface of inner race ring 33 of the second ring bearing is a spacer element 60 provided for the same purpose.

For purposes of constructing a skate 14 incorporating the structure of bearings of FIGS. 4 and 5, it will be recognized by those skilled in the art that the bearing structure 22 may first be assembled by the assembly of the first and second ring bearing and thereafter by the insertion of roller elements 26, 27 and 28. In this regard, roller elements 26, 27 and 28 are inserted by displacing support rods 43 and 44 inwardly within throughbore 42, positioning the spacer elements 59 and 60 together with the support rods 43 and 44 in axial alignment with bores 46 and 47 and thereafter permitting the support rod to be displaced outwardly of throughbore 42 into bores 46 and 47. The action of spring 49 thus urges the support rod into the bores 46 and 47 such as to maintain roller element 27 in operating position. As is discussed above, the structure of the roller elements 26 and 28 is identical to that of roller element 27 and in this regard the assembly technique is also identical.

Once the bearing structure 22 is assembled, it is disposed within clamp ring 35 and positioned appropriately against support platform 18 such that openings 36 in the clamp ring are aligned with suitable holes previously formed in the support platform. Thereafter, securing screws 37 may be positioned such as to cause the bearing structure to be securely attached to the support platform 18.

With the structure so assembled and with the appropriate number positioned as desired on a support platform, a skater may utilize the skate to achieve degrees of freedom and mobility heretofore unknown within the context of a skate having a roller surface element as distinguished from a ball element in contact with a supporting surface such as floor 24 or the like.

Figure 6:
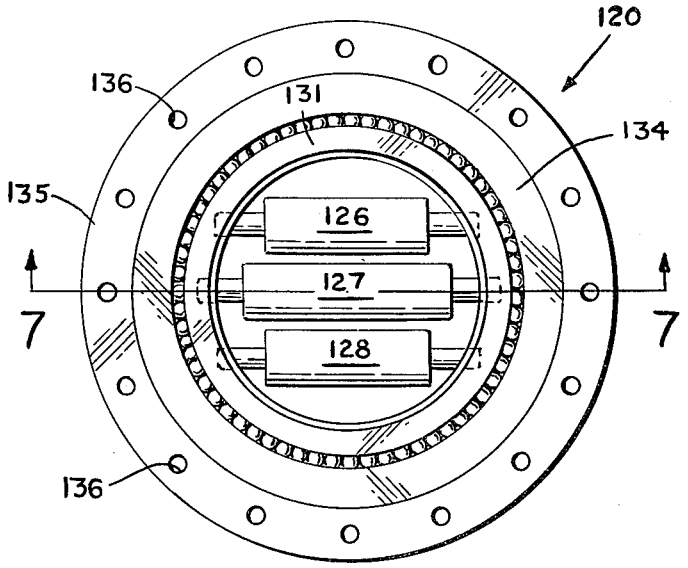
FIG. 6 is a plan view of yet another bearing structure which may be utilized in the present invention.
Figure 7:
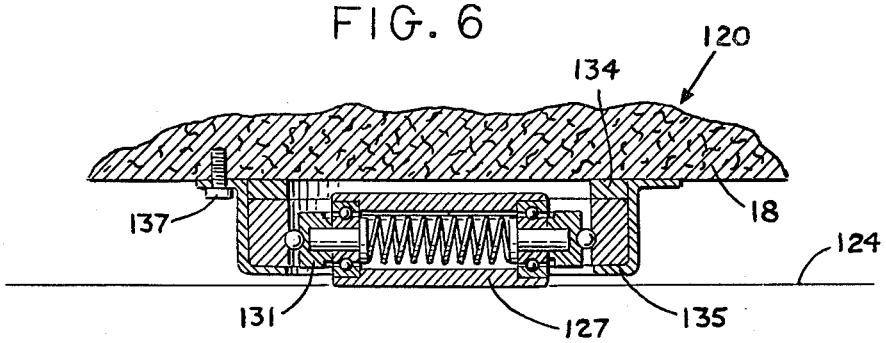
FIG. 7 is a cross-sectional elevational view to the plane 7—7 of FIG. 6.

Referring now to FIGS. 6 and 7 a second embodiment of bearing means which may be utilized with a skate such as skate 14 (FIGS. 1–3) is disclosed to be attached to a support platform 118.

Bearing structure 122 comprises a roller means including three roller elements 126, 127 and 128 which are mounted within the inner race of a ring bearing comprising part of the pivotal mounting structure as is discussed below in detail.

The pivotal mounting structure comprises a ring bearing having an outer race 130, an inner race 131 and a plurality of balls to provide low friction movement therebetween as is recognized in these arts.

Outer ring 130 of the ring bearing is rigidly secured to structural platform 118 by a clamp ring 135 having a plurality of holes 136 through which pass securing screws 137 for cooperation with suitable openings formed in support platform 118. The upper surface of outer race 130 is displaced from support platform 118 by a spacer ring 134. Spacer ring 134 is of a thickness to insure that rollers 126, 127 and 128 are sufficiently clear of support platform 118 to roll freely.

It can be seen, therefore, that as outer ring 130 is secured with respect to support platform 118, inner ring 131 is permitted to rotate within outer ring 130.

Inner ring 131 of the ring bearing is provided with a plurality of opposed pairs of bores, the longitudinal axes of which are parallel and which define bores for receiving therein roller elements 126, 127 and 128 in the same manner as discussed above with respect to inner ring 33 of bearing 20. Further, the structure of rollers 126, 127 and 128 is identical to the structure of roller 27 described above with respect to the embodiment of FIGS. 4 and 5. Accordingly, no further detailed description of the rollers is deemed necessary.

Assembly of bearing 120 is similar to the assembly of bearing 22. More specifically, roller means 126, 127 and 128 are suitably positioned within the bores of inner race 131 and retained in position by reason of the spring loaded support shafts as discussed above. The assembled ring bearing and roller combination is positioned within clamp ring 135 whereafter spacer ring 134 is positioned over outer race 130. With the bearing structure thus assembled, it is positioned appropriately against support platform 118 such that the openings 136 in the clamp ring 135 are aligned with suitable holes previously formed in the support platform. Thereafter, securing screws 137 may be positioned such as to cause the bearing structure to be securely attached to the support platform 118.

It is not necessary to use single roller elements such as rollers 26, 27, 28, 126, 127 and 128 as noted above. Thus, there is shown in FIG. 8 a roller element designated generally by the reference numeral 65 which may be substituted for the roller elements previously discussed.

Figure 8:
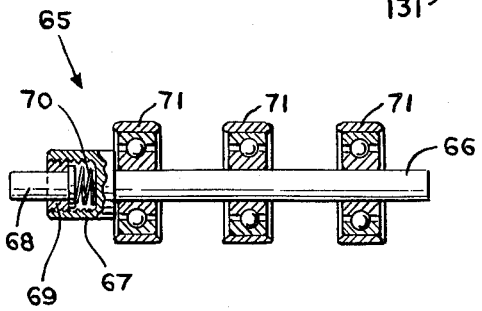
FIG. 8 is a cross-sectional elevational view of an alternative embodiment of roller structure which may be utilized in the structure of either FIGS. 4 or 6.

Referring, therefore to FIG. 8, roller element 65 can be seen to comprise a support shaft 66 having a counterbore cup 67 formed on one end thereof. Slidably received within counterbore cup 67 is a locking shaft 68 comprising a shaft having a diameter substantially equal to shaft 66 and a flange formed on the end thereof which is received within counterbore cup 67.

The inner surface of counterbore cup 67 is threaded so as to provide for the receipt therein of a locking ring 69 which cooperates with the flange formed on locking shaft 68 to retain locking shaft 68 slidably within counterbore cup 67 against the urgency of a spring 70. Thus, locking shaft 68 is displaceable inwardly within counterbore cup 67 against the action of spring 70. However, absent externally exerted force against locking shaft 68, spring 70 urges locking shaft 68 outwardly of counterbore cup 67 until the flange of locking shaft 68 is in surface-to-surface contact with locking ring 69.

Rigidly secured in spaced relation on support shaft 66 are three wheel members 71. Wheel members 71 are identical in structure and are substantially standard roller bearing wheels having suitable contact surface material disposed around the outer surface of the outer race such as to form an appropriate surface for coming in contact with the support means. The wheel members may be secured to support shaft 66 by shrink fitting or like techniques generally known to those having skill in these arts.

It can be seen, therefore, that roller elements 65 constitutes a roller structure which may be substituted for the roller elements previously disclosed and which is suitable for the high degree of freedom desired to be achieved by the bearing means and skate structure of the present invention.

Figure 9:
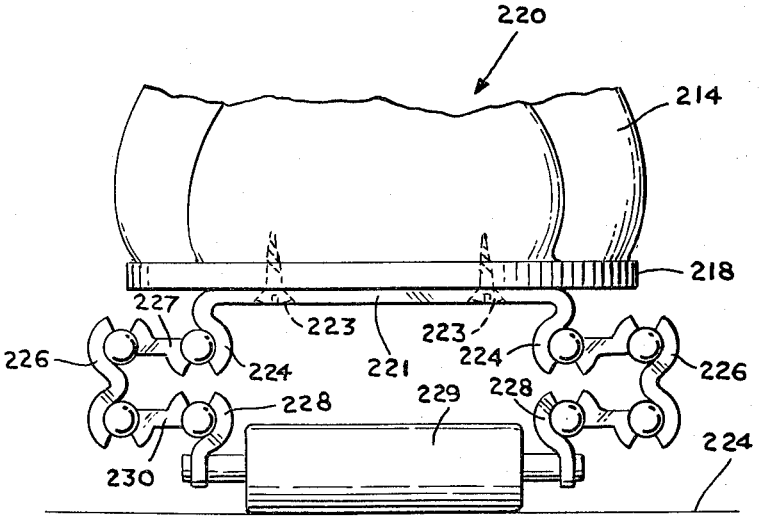
FIG. 9 is a cross-sectional elevational view of yet another embodiment of bearing structure which may be utilized in the present invention.

Referring now to FIG. 9, yet another bearing structure for use in respect to skate 14 is disclosed. More specifically, the bearing structure of FIG. 9 is designated generally by the reference number 220 and can be seen to comprise an upper bearing structure and a lower bearing structure. The upper bearing structure incorporates a retaining plate 221 which is rigidly secured to the underside of support platform 218 of skate shoe 214 by securing elements such as screws 223 which extend through suitable holes formed in retaining plate 221. The outer periphery of retaining plate 221 is provided with an annular shoulder 224 which defines an inner race for the inner set of ball bearings of a compound ball bearing structure. In this regard, the compound ball bearing structure includes inner race 224, outer race 226 and intermediate race 227 all as shown generally schematically in FIG. 9.

Outer race 226 also constitutes the outer race of lower bearing structure which lower bearing structure includes outer race 226, inner race 228 and intermediate race 230. Depending from inner race 228 is an annular collar which defines a mounting means for the axes of a plurality of roller bearings 229 which may be structured in the same manner as described above with respect to the roller bearings 26, 27 and 28 as seen in FIG. 4.

The double compound bearing structure of FIG. 9 provides unique multiple degrees of freedom not heretofore experienced and in particular provides a full 360° range of motion with a minimum of resistance.

Manufacture and assembly of the structure shown in FIG. 9 may be accomplished through the use of known materials and components with known manufacturing and assembly techniques. Thus, no detailed description of these techniques is deemed necessary.

It will be recognized by those skilled in these arts that the above-described embodiments of skate structure provide apparatus which permit a freedom of movement not heretofore achieved in operable skate structures. The cooperation of roller type means and rotational bearing means results in a complete range of motion which permits skating activities and freedom of skater movement not heretofore contemplated.

It will be recognized, however, that many modifications and variations to the above-described preferred embodiment may be utilized without departing from the spirit and scope of this invention.

I claim:

1. Skate structure including:

a support platform;

roller means for providing a rolling contact between said skate structure and a support surface; and first and second ring bearings for pivotally mounting said roller means to said support platform, each of said ring bearings having an outer race and an inner race, said outer race of said first ring bearing being rigidly secured to said support platform, said outer race of said second ring bearing being rigidly secured to said inner race of said first ring bearing and said roller means being secured to said inner race of said second ring bearing.

* * * * *